US006168494B1

(12) United States Patent
Engel et al.

(10) Patent No.: US 6,168,494 B1
(45) Date of Patent: Jan. 2, 2001

(54) EXPANDABLE AND CHANGEABLE PLAYSET BUILDING SYSTEM

(76) Inventors: Robert William Engel, 548 N. Hollyburne La., Thousand Oaks, CA (US) 91360; Stephen George Fouke, 14014 Panay Way, No. 283, Marian del Rey, CA (US) 90292; John Rey Hollis, 21540 Encina Rd., Topanga, CA (US) 90290

( * ) Notice: Under 35 U.S.C. 154(b), the term of this patent shall be extended for 0 days.

(21) Appl. No.: 09/368,539

(22) Filed: Aug. 5, 1999

Related U.S. Application Data

(60) Provisional application No. 60/095,857, filed on Aug. 8, 1998.

(51) Int. Cl.[7] ..... A63H 3/52

(52) U.S. Cl. ..... 446/477; 446/111; 446/112; 446/484

(58) Field of Search ..... 446/477, 478, 446/107, 108, 109, 110, 91, 484, 387, 111, 112, 115, 487, 189; 104/DIG. 1; 238/10 D, 10 E, 10 F

(56) References Cited

U.S. PATENT DOCUMENTS

| | | | | |
|---|---|---|---|---|
| 4,941,859 | | 7/1990 | Zaruba . | |
| 5,445,552 | | 8/1995 | Hine . | |
| 5,487,690 | * | 1/1996 | Stoffle et al. | 446/112 |
| 5,890,338 | | 4/1999 | Rodriguez-Ferre . | |

* cited by examiner

*Primary Examiner*—Jacob K. Ackun
*Assistant Examiner*—Urszula M. Cegielnik
(74) *Attorney, Agent, or Firm*—O'Connell Law Firm

(57) ABSTRACT

An expandable and changeable playset building system with at least one retained playset member, which may comprise a resiliently compressible panel, and at least one squeeze connector, which may be formed from a pair of opposed gripping surfaces, for selectively retaining the retained playset member by frictional engagement. An interactive base connector unit can be provided that simulates a structure, such as a bridge, a tree, a fence, a merry-go-round, or a parking gate, in miniature and in three dimensions. A plurality of squeeze connectors can be coupled to the interactive base connector unit for retaining a plurality of retained playset members. Also, first and second squeeze connectors could be rotatably coupled together. Further, a plurality of squeeze connectors with a plurality of different orientations could be fixedly joined to form a fixed universal connector.

Electrical current can be transmitted between the interactive base connector unit and the retained playset members by corresponding electrical contacts. The interactive base connector unit can have an electrical switch and an electrically powered element that is activated by a triggering of the switch. The switch could be a layer of electrically conductive ink applied to the interactive base connector unit with a gap therein wherein a user can close the gap to trigger the switch by application of an external electrically conductive element, such as a finger, that bridges the gap. Alternatively or additionally, such a switch could be provided on the retained playset members.

20 Claims, 9 Drawing Sheets

EXPANDABLE AND CHANGEABLE PLAYSET BUILDING SYSTEM

This application claims benefit to U.S. Provisional Ser. No. 60/095,857 Aug. 8, 1998.

FIELD OF THE INVENTION

The present invention relates generally to playsets. Stated more particularly, disclosed herein is an expandable and changeable playset building system.

BACKGROUND OF THE INVENTION

It will be recognized that the prior art discloses playsets of many types, each designed with the intent of providing recreation and education to children and adults. For example, many playsets have been designed that are of a permanent type wherein a miniature structure of a fixed configuration is provided. Although these structures certainly provide entertainment to users, they can be disadvantageous for a number of reasons. For example, the fixed arrangement of such structures makes shipment and storage problematic. Furthermore, the inability to modify these structures limits the exercise of the user's imagination and consequently may reduce the enjoyable lifetime of the dollhouse.

Other play structures are of a knockdown type that can be assembled and disassembled.

Often, this type of playset enables varied configurations. Advantageously, such structures address the shipping and storage difficulties exhibited by permanent type dollhouses. Furthermore, they often allow a user to exercise his or her imagination. Unfortunately, however, these knockdown type structures to date have tended to be relatively complicated in construction. For example, such playsets often require various fasteners, locking members, and, possibly, tools for their proper construction and use.

With regard to either type of playset structure, however, one will appreciate that such structures can present potential dangers to users due to the typically rigid configurations of the playsets. Furthermore, prior art playsets often present sharp edges and corners that can injure users and make use of the playset structure less safe and, possibly, less comfortable to work with and manipulate.

Still other miniature settings have been created that enable a user to connect a number of miniature building members together mechanically and electrically. For example, U.S. Pat. No. 5,445,552 to Hine et al. provides a plurality of base units that can be connected both mechanically and electrically. Each base unit is designed to retain a miniature building. Disadvantageously, such structures as that disclosed by Hine et al. historically have been mechanically and electrically complex. Consequently, they can be costly and difficult to manufacture, and they often have required a degree of expertise on the part of a user for proper assembly and operation.

In light of the above, it becomes clear that a playset solving one or more of the above-described problems left by the prior art would be useful. It is still more clear that a playset providing a solution to each and every deficiency exhibited by the prior art while demonstrating a number of heretofore-unrecognized advantages thereover would comprise a marked advance in the art.

SUMMARY OF THE INVENTION

In light of the above-described state of the prior art, a few objects and advantages of the present invention are worth particular mention.

Advantageously, a broadly stated object of the invention is to meet the needs left by the prior art while providing a number of heretofore unrealized advantages thereover.

Stated more particulary, a principal object of the present invention is to provide a playset that is capable of assuming a wide variety of configurations.

Another object of the invention is to provide a playset that can be configured and supplemented in an exceedingly simple manner with little expertise or dexterity whereby a user can create large, specially adapted playsets quickly and easily.

Resultant objects of the invention include enabling a user to exercise his or her ingenuity and imagination and enabling a user to enjoy an extended duration of enjoyment of the playset.

A further object of the invention is to provide a playset that can be disassembled readily and stored in a compact manner for convenient storage and efficient transportation.

Yet another object of the invention is to provide a playset that not only allows a user to exercise his or her ingenuity and imagination during play with the playset but that also allows a user S to demonstrate analytical ability during disassembling and storage of the playset.

A still further object of the invention is to provide a playset that can transmit electric power across members of the playset structure in a safe and simple manner that requires substantially no expertise on the part of a user.

Still another object of the invention is to provide a playset structure that is exceedingly safe and comfortable in use.

Undoubtedly, these and further objects and advantages of the instant invention will be obvious both to one who reviews the present disclosure and to one who has an opportunity to make use of an embodiment of the expandable and changeable playset building system disclosed herein.

In accomplishing these objects, a most basic embodiment of the present invention for an expandable and changeable playset building system comprises at least one retained playset member, which has a portion that is resiliently compressible, and at least one squeeze connector for selectively retaining the retained playset member by frictional engagement. Under this arrangement, the at least one squeeze connector and the at least one retained playset member can be retained in a given configuration by a frictional engagement between the squeeze connector and the retained playset member. Preferably, the retained playset member will comprise a panel of resiliently compressible material with an ornamental design applied to its surface. An expandable and changeable playset building system according to the present invention could provide a plurality of resilient compressible panels.

The resiliently compressible panels could be cut from a sheet of resilient compressible material. Indeed, the expandable and changeable playset building system could be distributed with the resiliently compressible panels removably and replacably retained within the sheet of resiliently compressible material in a jigsaw puzzle arrangement. With this, a user could remove the plurality of resiliently compressible panels from the sheet of resiliently compressible material for play, and the user could return the resiliently compressible panels to their respective places and orientations in the sheet of resiliently compressible material. As a result, not only will the invention be subject to storage and shipment in an exceedingly neat and efficient block configuration, but also a user will enjoy the added challenge of replacing the resiliently compressible panels in their proper location and orientation.

Each squeeze connector may comprise a pair of opposed inner gripping surfaces for frictionally engaging the resilient compressible portion of the retained playset member. Preferably, the opposed inner gripping surfaces will terminate in arcuate outer edges that are inwardly angled such that the outer edges exhibit a funnel-type configuration for better receiving and compressing the resiliently compressible portion of the retained playset members. Still more preferably, the opposed inner gripping surfaces of the squeeze connectors will be closer together than a thickness of the resiliently compressible portion of the retained playset member so that frictional engagement will be ensured.

Although the squeeze connectors could be employed in a number of ways, one preferred embodiment of the invention could rotatably couple a first squeeze connector to a second squeeze connector. With this, the orientation of the first squeeze connector relative to the second squeeze connector can be varied readily. Another embodiment of the invention could fix first and second squeeze connectors in a back-to-back relationship whereby the first and second squeeze connectors exhibit an H configuration in what may be termed a fixed connector. Under this arrangement, the fixed connector can couple first and second resilient foam panels in a butting relationship when laying flat relative to a ground surface, standing upright, or assuming substantially any other disposition.

Still further, embodiments of the invention could fixedly join a plurality of squeeze connectors with a plurality of different orientations to form a fixed universal connector. With this, such a fixed universal connector could fixedly retain a plurality of retained playset members in different orientations.

In preferred embodiments, an interactive base connector unit that simulates a structure in miniature and in three dimensions may form what may be considered a foundation of the playset building system. For example, the interactive base connector unit may simulate one or more of a bridge, a tree, a fence, a merry-go-round, or a parking gate. Where such an interactive base connector unit is provided, a plurality of squeeze connectors may be coupled to and extend from the interactive base connector unit for retaining a plurality of retained playset members.

The invention may further include a means for transmitting an electrical current between the interactive base connector unit and the retained playset members in the form of corresponding electrical contacts on the retained playset members and the inner gripping surfaces of the plurality of squeeze connectors. An electrical switch may be operably associated with the interactive base connector unit for activating an electrically-powered element by use of a means for doing so that is operably associated with the interactive base connector unit. This switch could assume a number of forms. For example, there may be a traditional ON/OFF switch. Alternatively or additionally, the switch could comprise a layer of electrically conductive ink applied to at least a portion of the interactive base connector unit with a gap therein. With this, a user can close the gap to trigger the switch by application of an external electrically conductive element, such as a finger or the like, that bridges the gap. Still further, where the interactive base connector unit simulates a bridge, the switch could comprise a plank in the bridge that is triggered by a displacement of the plank.

Preferred embodiments of the invention will further include a means for transmitting an electrical current across at least a portion of the retained playset members. This means could comprise a layer of electrically conductive ink applied to the surface of the retained playset member.

In any case, however, the means could comprise a continuous first electrical path for transmitting electrical current and a second electrical path with a gap therein for acting as a switch for allowing electricity to pass along the first electrical path when the gap is closed. That second electrical path could comprise a layer of electrically conductive ink with a gap therein applied to at least a portion of the surface of the retained playset member. With this, a user can close the gap and allow electricity to pass along the first electrical path by application of an external electrically conductive element, such as a finger, to bridge the gap.

One will appreciate that the foregoing discussion broadly outlines the more important features of the invention to enable a better understanding of the detailed description that follows and to instill a better appreciation of the inventors' contribution to the art. Before an embodiment of the invention is explained in detail, it must be made clear that the following details of construction, descriptions of geometry, and illustrations of inventive concepts are mere examples of the many possible manifestations of the invention,

DETAILED DESCRIPTION OF PREFERRED EMBODIMENTS

As with many inventions, the present invention for an expandable and changeable playset building system can assume a wide variety of embodiments. However, to assist those reviewing the present disclosure in understanding and, in appropriate circumstances, practicing the present invention, a few particularly preferred embodiments of the expandable and changeable playset building system will be disclosed hereinafter.

Figure 1:
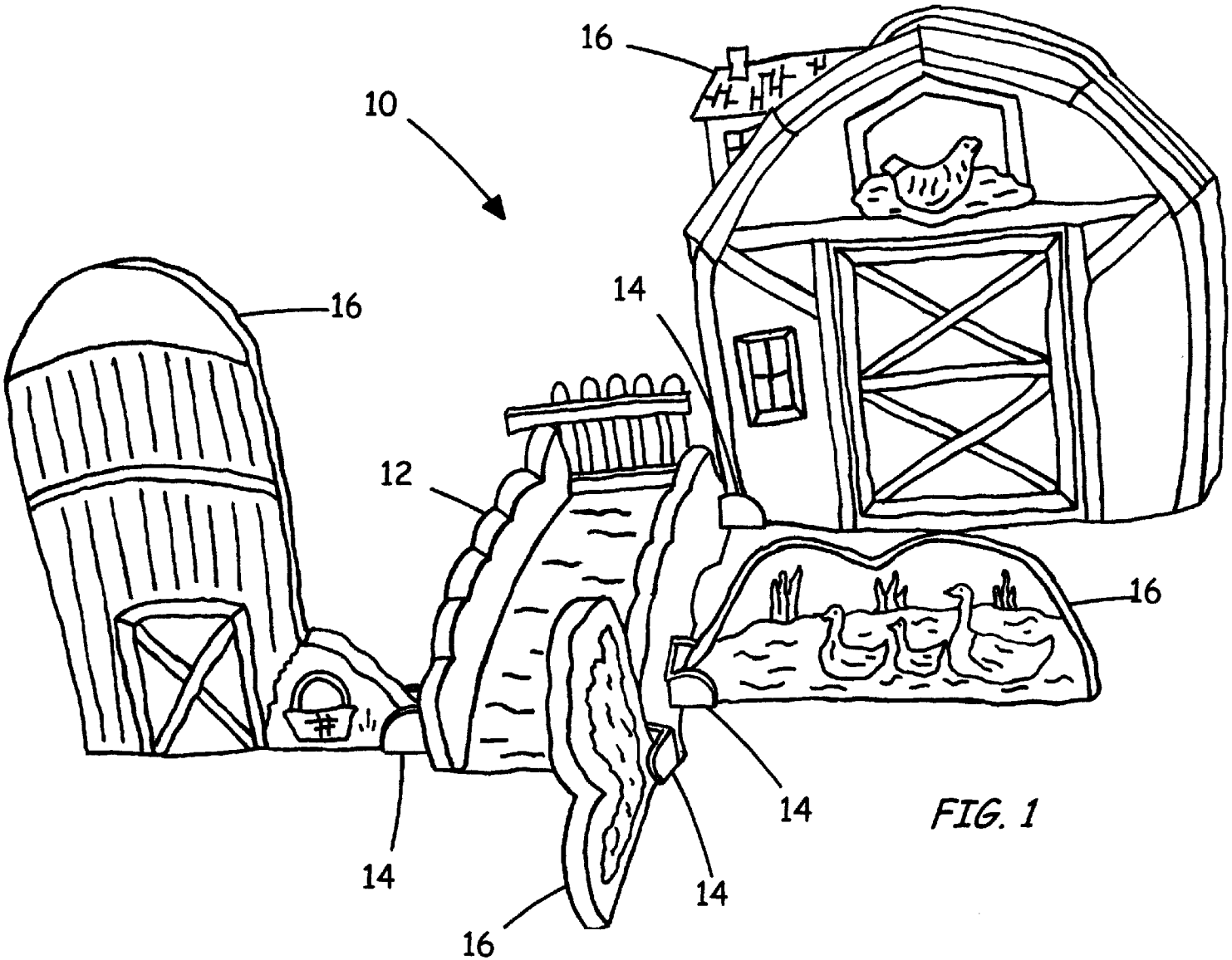
FIG. 1 is a perspective view of an expandable and changeable playset building system according to the present invention.

Looking more particularly to the drawings, a first preferred embodiment of the present invention for an expandable and changeable playset building system is indicated generally at 10 in FIG. 1. In this embodiment, an interactive base connector unit 12 is provided in the form of a miniature bridge, which also is indicated at 12. A plurality of squeeze connectors 14, the structure and operation of which will be described in greater detail below, extend from the bridge 12. Although the interactive base connector units 12 could have a varying number of parts depending on the play activity, theme, and function of the interactive base connector unit 12, each interactive base connector unit 12 preferably will have two or more squeeze connectors 14 extending therefrom. In use, each of the squeeze connectors 14 retains a resilient foam panel 16 whereby each of the resilient foam panels 16 could be termed equally aptly a retained playset member. As FIG. 1 would indicate and as will be discussed more fully below, the resilient foam panels 16 can assume an endless variety of shapes, sizes, and appearances.

Figure 2:
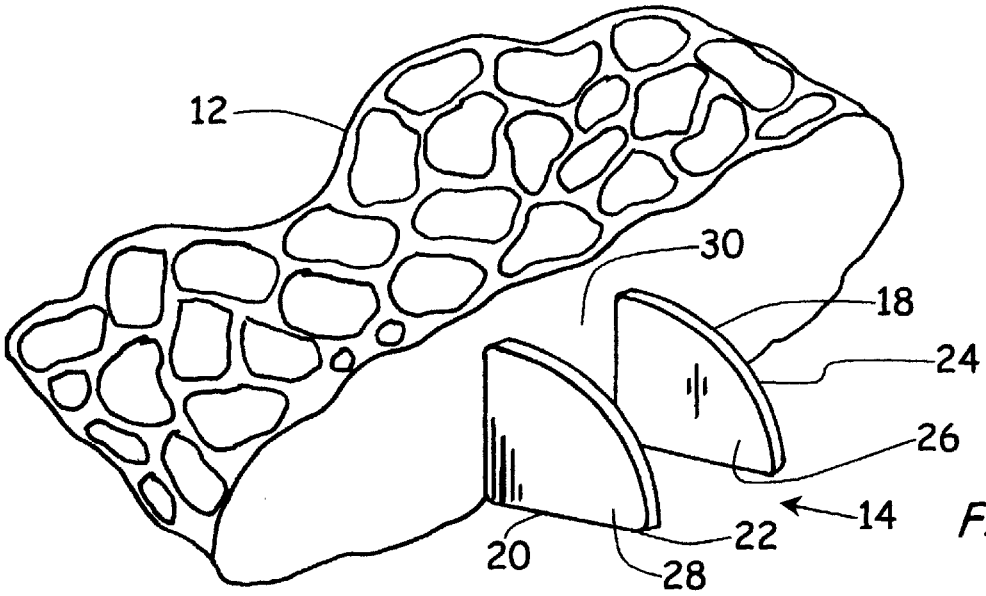
FIG. 2 is a perspective view of an interactive base connector unit according to the present invention.

To enable a greater understanding of the invention, FIG. 2 depicts a portion of an interactive base connector unit 12 with a squeeze connector 14 extending therefrom without a resilient foam panel 16. As one will see, each squeeze connector 14 comprises a first fin 18 and a second fin 20. Each of the first and second fins 18 and 20 has a flat bottom 22 and an arcuate outer edge 24 curving upwardly from the bottom 22 to meet the body of the interactive base connector unit 12. For reasons that will be made most clear below, the opposing surfaces of the first and second fins 18 and 20 may appropriately be termed opposed inner gripping surfaces 26. Because their flat nature readily permits the application of decoration and the like to them, the outer surfaces of the first and second fins 18 and 20 may well be termed outer decorating surfaces 28. The portion of the interactive base connector unit 12 between the first and second fins 18 and 20 acts as a backstop surface 30. The fins 18 and 20 preferably are formed from a generally rigid material that most preferably will exhibit some amount of resilient deflection. Although a number of materials certainly could be employed, plastic presently seems to be ideal.

Figure 3:
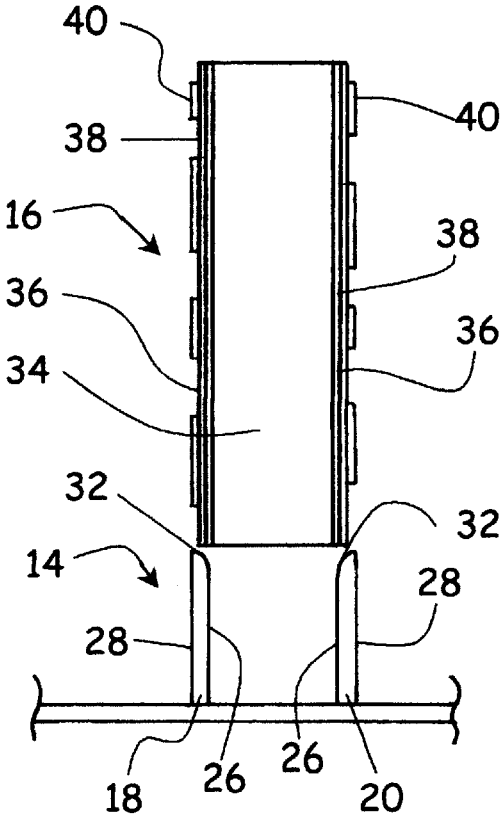
FIG. 3 is a view in side elevation of a resilient foam panel prior to insertion into a squeeze connector.

Tuning to FIG. 3, one sees in cross section a resilient foam panel 16 according to the present invention disposed adjacent to a squeeze connector 14. As FIG. 3 shows, the outer edges 24 of the first and second fins 18 and 20 are arcuate not only in profile but also in cross section. Stated more particularly, the outer decorating surfaces 28 of the fins 18 and 20 are longer than the inner gripping surfaces 26 and the surfaces 28 and 26 are joined by the arcuate outer edge 24. With this, the outer edges 24 of the fins 18 and 20 are inwardly angled in a funnel-type configuration.

As its name would suggest, the resilient foam panel 16 is founded on a layer of resilient foam 34. Substantially any type of foam would be usable, but it preferably will be resiliently compressible.

Although a wide variation in thickness could be employed, it is presently preferred to craft the panel 16 with an overall thickness between ¼ inch and ½ inch. With this, the foam panel 16 would be likely to fall over if not retained by the squeeze connector 14. Layers of flexible plastic 38 are laminated to each of the outer surfaces of the layer of resilient foam 34, Finally, applied to the outside of the layers of plastic 38 is a layer of ink 40.

Under this arrangement, the layer of ink 40 in combination with the shape of the foam panel 16 allows each foam panel 16 to assume a unique ornamental appearance. As FIG. I exemplifies, the resilient foam panel 16 could assume a wide range of sizes and designs whereby it could vary from being, for example, small and having a gaggle of geese illustrated thereon to being large with a barn depicted thereon. Furthermore, the opposite sides of each of the foam panels 16 could be ornamented with different designs. With this, a user can change the appearance of the expandable and changeable playset building system 10 simply by turning the foam panels 16 around or by viewing the expandable and changeable playset building system 10 from a sufficiently different angle.

Figure 16:
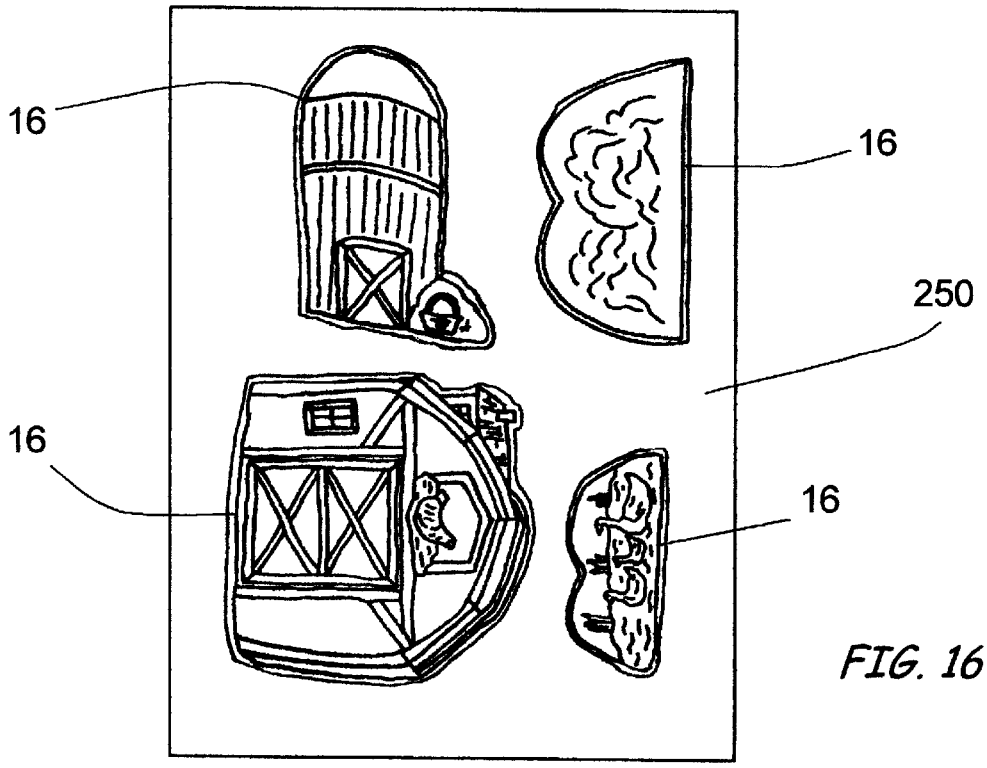
FIG. 16 is a view in front elevation of a resilient foam sheet from which a plurality of resilient foam panels are formed.

The resilient foam panels 16 certainly could be formed in a variety of ways. For example, as FIG. 16 illustrates, the resilient foam panels 16 could be cut from an entire resilient foam sheet 250. With this, the expandable and changeable playset building system 10 could be sold or otherwise provided with the resilient foam panels 16 removably and replacably retained within the remainder of the resilient foam sheet 250. Under this arrangement, the expandable and changeable playset building system 10 would be subject to an extremely compact shipping configuration in the simple form of one or more resilient foam sheets 250. Furthermore, a user's reinserting the resilient foam panels 16 into their original positions and orientations within the remainder of the resilient foam sheet 250 could act as a puzzle to be solved by the user during his or her dismantling and storing of the expandable and changeable playset building system 10.

As FIG. 3 shows, the outer decorating surfaces 28 are just slightly further apart than the resilient foam panel 16 is thick. However, the inner gripping surfaces 26 are closer together than the resilient foam panel 16 is thick. With this, as a resilient foam panel 16 is pressed into engagement with the squeeze connector 14, the edges of the resilient foam panel 16 will first engage the inwardly inclined surfaces of the outer edges 32. As the resilient foam panel 16 is pressed further into the squeeze connector, the funnel-type configuration of the outer edges 32 will tend to compress the resilient foam panel 16 to allow it to slide into the space between the first and second fins 18 and 20. As FIG. 4 would indicate, the compression of the resilient foam panel 16 between the first and second fins 18 and 20 will induce a frictional engagement therebetween that will tend to restrain the resilient foam panel 16 relative to the squeeze connector 14 to prevent relative movement therebetween.

Figure 5:
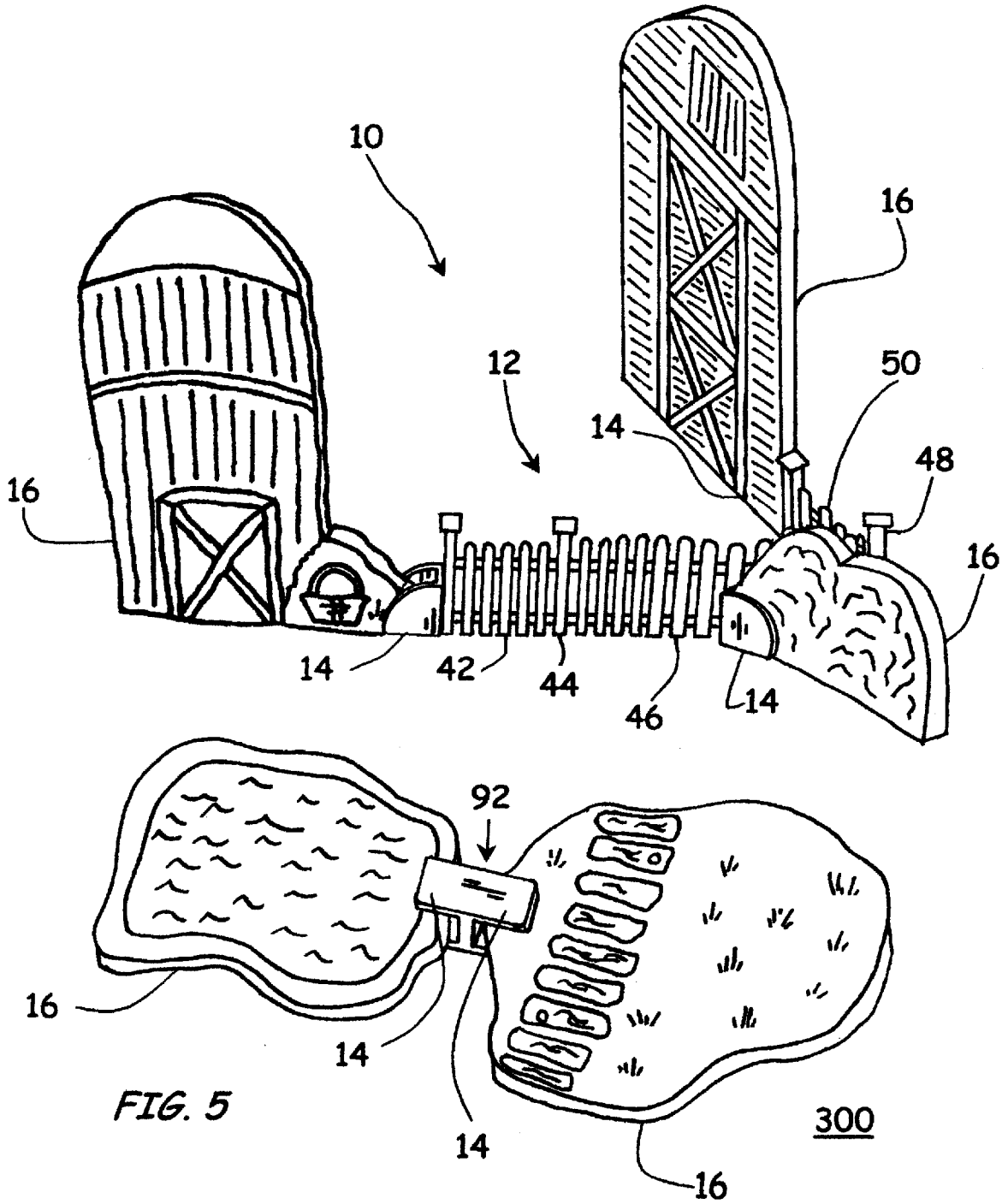
FIG. 5 is a perspective view of an alternative expandable and changeable playset building system.

The versatility of the present invention is further illustrated in FIG. 5 where the interactive base connector unit 12 is illustrated in the form of a fence, which is also indicated at 12. The fence 12 has a plurality of squeeze connectors 14 extending therefrom with each squeeze connector 14 frictionally retaining a resilient foam panel 16. As one will see, a first foam panel 16 has the shape and appearance of a silo or the like, a second foam panel 16 imitates a grassy area, and a third foam panel 16 is shaped and colored to look like a barn. For greatest stability, all foam panels 16 have flat bottom surfaces for allowing greatest contact with a ground surface (not explicitly shown). To allow a user greatest flexibility in arranging the interactive base connector unit 12, the fence 12 is formed with a first section 42 that is coupled by a hinge 44 to a second section 46 that is coupled by a hinge 48 to a third section 50. With this, the double-jointed fence 12 can be manipulated into a wide variety of configurations.

A further refinement of the invention is shown in FIG. 5 where the fence-type interactive base connector unit 12 and related structure is supplemented by first and second resilient foam panels 16 that lie flat relative to the ground surface 300. In such a case, the resilient foam panels 16 can simulate structures that typically would lie on a ground surface 300. For example, in this embodiment, one resilient foam panel 16 simulates a pond while the second resilient foam panel 16 simulates a wooden walkway on a grassy surface. The first and second foam panels 16 are connected by a fixed connector 92 that comprises first and second squeeze connectors 14 that are fixed together in a back-to-back relationship whereby they approximate an H configuration. Under this arrangement, the fixed connector 92 can retain resilient foam panels 16 in a butting relationship while they lie on a ground surface 300, stand upright, or align in substantially any other configuration.

Figure 6:
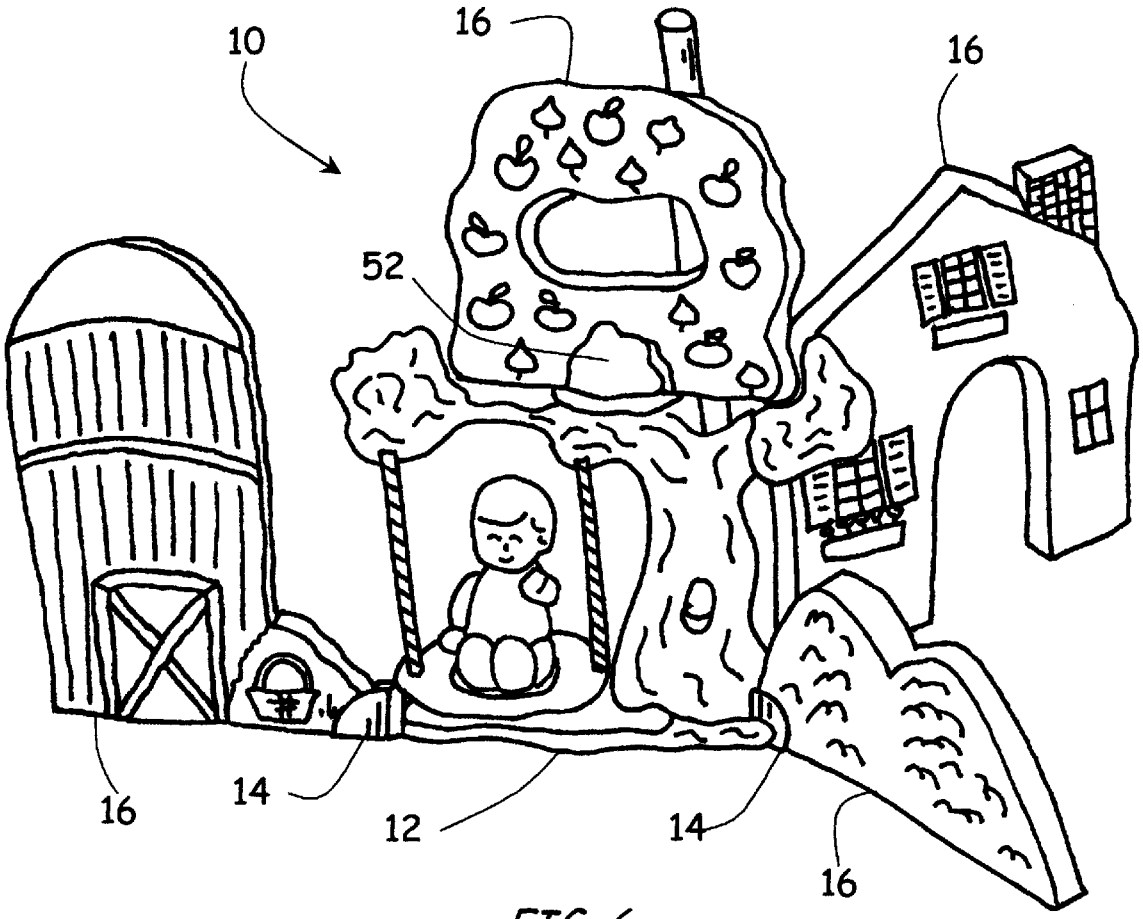
FIG. 6 is a perspective view of another alternative expandable and changeable playset building system.

Yet another embodiment of the expandable and changeable playset building system 10 is illustrated in FIG. 6. In this case, the interactive base connector unit 12 comprises a tree with a swing, which again is indicated at 12. As with each of the earlier embodiments, the tree 12 has a plurality of squeeze connectors 14 extending therefrom. Each of these squeeze connectors 14 frictionally supports a resilient foam panel 16. However, FIG. 6 shows a still further refinement of the invention in the form of a rotatable squeeze connector 52 that retains a resilient foam panel 16 atop the tree 12. In FIG. 6, the rotatable squeeze connector 52 essentially comprises a squeeze connector 14 that is rotatably coupled to the tree 12 by an axle (not shown in this embodiment).

Figure 7:
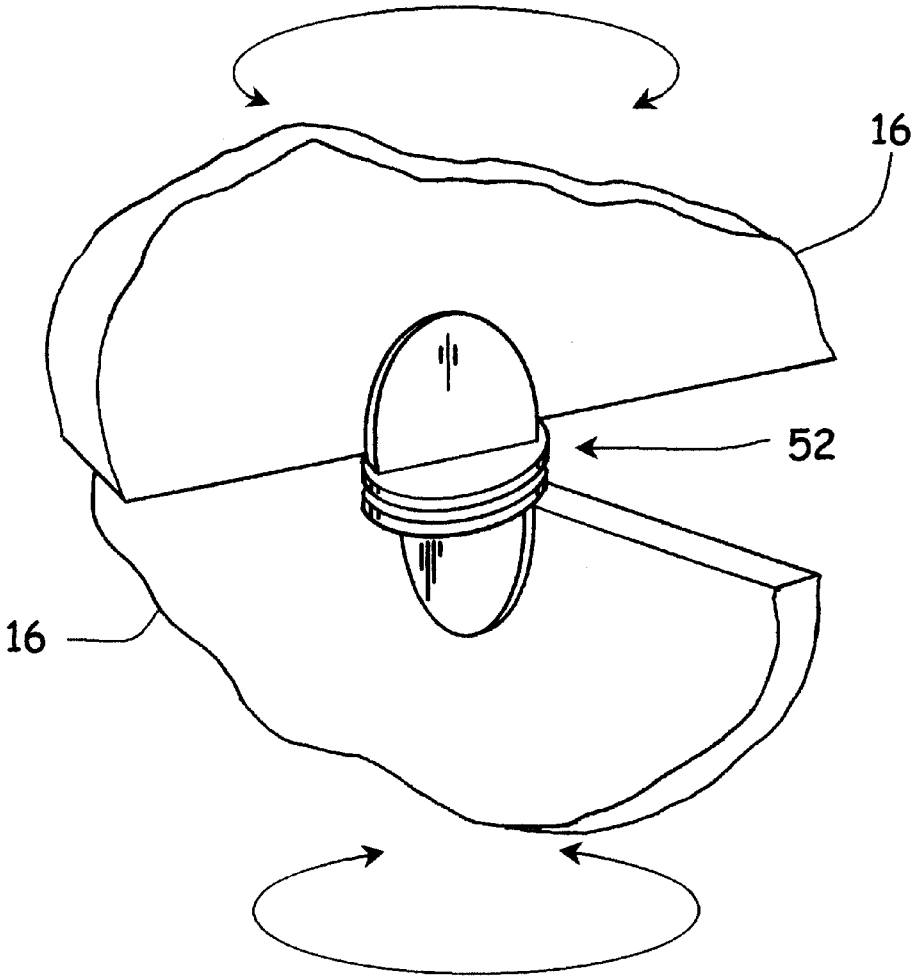
FIG. 7 is a perspective view of a rotatable squeeze connector retaining two resilient foam panels.
Figure 8:
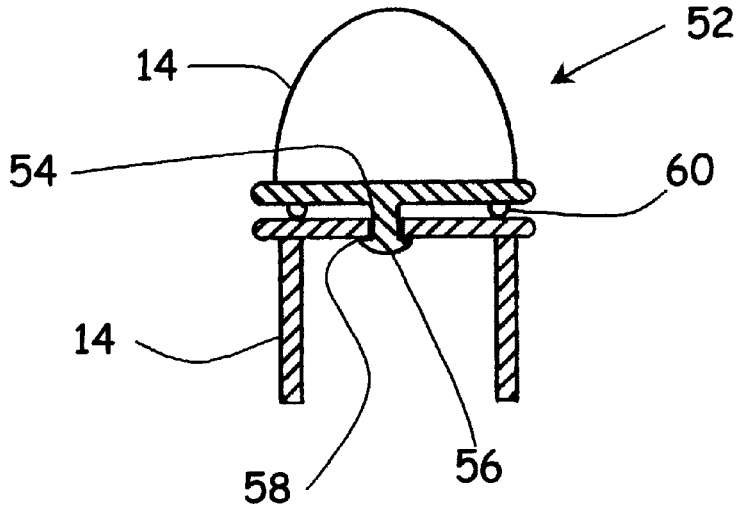
FIG. 8 is a cross-sectional view in side elevation of the rotatable squeeze connector of FIG. 7.

An alternative rotatable squeeze connector 52 is shown in a magnified view in FIG. 7 where it retains two resilient foam panels 16, and it is shown for still greater clarity in cross section in FIG. 8. As these figures show, the rotatable squeeze connector 52 in this embodiment essentially comprises two of the previously described squeeze connectors 14 rotatably coupled in a back-to-back relationship. Although this rotatable coupling could certainly be accomplished in a number of ways, the present embodiment of the rotatable squeeze connector 52 does so by providing an axle 54 that projects from one squeeze connector 14 that is rotatably received through an aperture 58 in the other squeeze connector 14. A snap lock 56 that is slightly wider than the aperture 58 is disposed at the distal end of the axle 54 for being pressed through the aperture 58 to retain the two squeeze connectors 14 together. A number of peripherally disposed projections 60 may be provided for maintaining the squeeze connectors 14 in an aligned relationship. Ideally, the axle 54 will be sized to retain the squeeze connectors 14 in a tight, frictionally engaged relationship wherein the squeeze connectors 14 will resist unintentional rotation relative to one another. The rotatable squeeze connector 52 of FIG. 6 is an analogous arrangement except that one of the squeeze connectors 14 is replaced by the upper portion of the tree 12.

As FIG. 7 exemplifies, the rotatable squeeze connector 52 can retain two resilient foam panels 16 in any desired relative orientation. The rotatable squeeze connector 52 could be used in a number of ways. As FIG. 6 shows, the rotatable squeeze connector 52 could be employed with the squeeze connector 14 rotatably coupled to the tree-type interactive base connector unit 12 for retaining an upstanding resilient foam panel 16. Since the rotatable squeeze connector 52 allows foam panels 16 to be rotated easily, a user can readily alter the appearance of the expandable and changeable playset building system 10 simply by rotating the foam panel 16. For example, the foam panel 16 that is disposed atop the tree 12 could have green leaves with apples printed on one side and fall leaves printed on the opposite side such that a user could change the appearance of the expandable and changeable playset building system 10 from a summer scene to a fall scene with a simple rotation of the foam panel 16.

Figure 9:
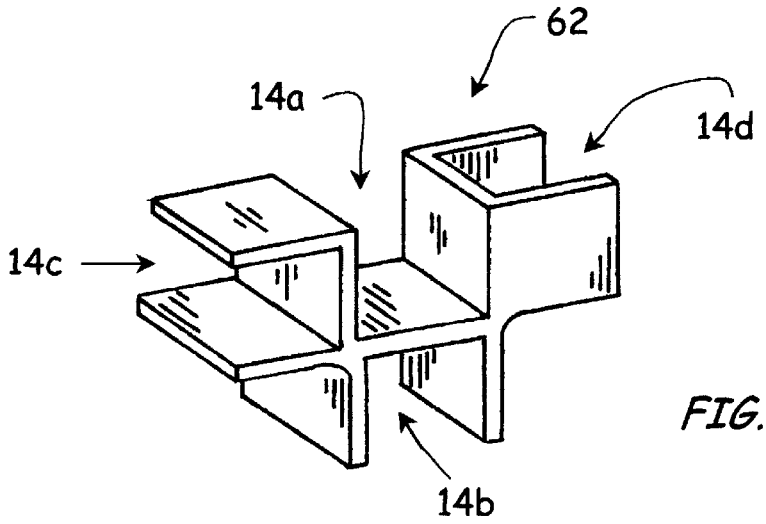
FIG. 9 is a perspective view of a unitary fixed universal connector according to the present invention.

Yet another potential refinement of the invention is shown in FIG. 9 in the form of a unitary fixed universal connector 62 that enables a plurality of resilient foam panels 16 (not shown) to be retained in different orientations. To do so, the fixed universal connector 62 provides first and second squeeze connectors 14*a* and 14*b* disposed in parallel panel-retaining orientations in a back-to-back relationship. A third squeeze connector 14*c* extends perpendicularly from a first side of the first squeeze connector 14*a* in a parallel panel-retaining orientation to the first and second squeeze connectors 14*a* and 14*b*. Finally, a fourth squeeze connector 14*d* extends perpendicularly from a second side of the first squeeze connector 14*a* with a panel-retaining orientation perpendicular to the first, second, and third squeeze connectors 14*a*, 14*b*, and 14*c*. Under this arrangement, the first and second squeeze connectors 14*a* and 14*b* can frictionally retain first and second resilient foam panels (not shown) in an end-to-end relationship, the third squeeze connector 14*c* can retain a third resilient foam panel (not shown) perpendicularly to the first and second foam panels but with a similar orientation thereto, and the fourth squeeze connector 14*d* can retain a fourth foam panel perpendicularly to the first and second foam panels with an orientation perpendicular thereto.

It will be clear that the embodiments of the invention shown in the aforedescribed figures are provided by way of example only. The appearances, shapes, and sizes of the resilient foam panels 16 and the interactive base connector units 12 can be varied readily within the scope of the present invention. Furthermore, the constituent elements of the embodiments can readily be interchanged. Of course, as the invention's name would suggest, further elements could readily be added to the depicted embodiments of the expandable and changeable playset building system 10. For example, one could quite simply couple each of the embodiments of FIGS. 1, 5, and 6 to create a miniature town or the like. This expandability and changeability, of course, leads to a number of the advantages of the invention including enabling a user to exercise his or her imagination and to enjoy enhanced and prolonged periods of playtime enjoyment.

Figure 4:
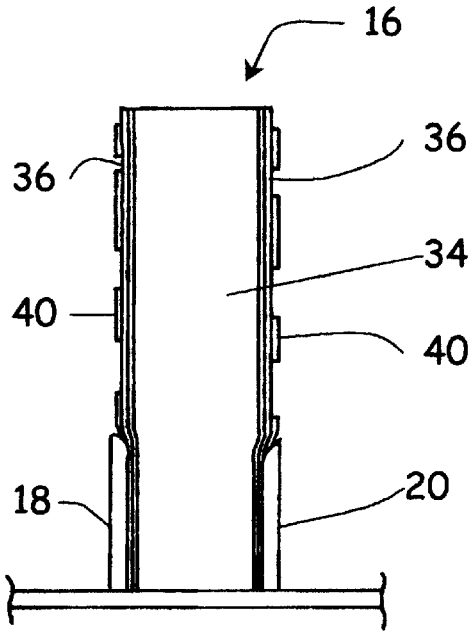
FIG. 4 is a view in side elevation of a resilient foam panel fully inserted into a squeeze connector.

Although the abovedescribed embodiments of the invention certainly would represent a useful advance in the art of playsets, the present invention is improved still further by the innovative inclusion of electronic features that allow a user to activate lights, sounds, movements, and combinations thereof To accomplish this, the resilient foam panels 16 are constructed in substantially the same manner as in FIGS. 3 and 4 except that at least some of the layer of ink 40 comprises electrically conductive ink. With this, electrical energy can be transmitted through and over the faces of the resilient foam panels 16 to accomplish a wide variety of purposes.

Figure 10:
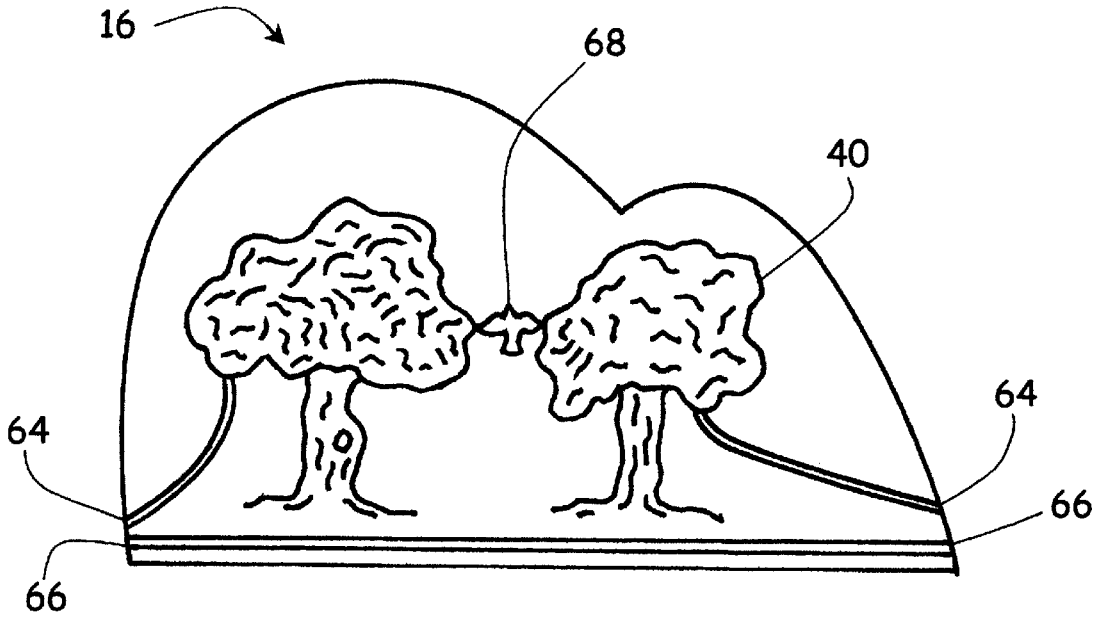
FIG. 10 is a view in front elevation of an alternative resilient foam panel according to the present invention.

The face of a resilient foam panel 16 embodying this aspect of the invention is shown in FIG. 10. In this embodiment, the layer of ink 40 is applied such that the ends of the resilient foam panel 16 each are provided with a first electrical contact 64 and a second electrical contact 66. The second electrical contacts 66 comprise a first electrical path that forms a portion of an electrical circuit that can activate, for example, a speaker (not shown) or other device. Most uniquely, though, the first electrical contacts 64 comprise a portion of a second electrical path that forms a switch circuit that passes over the face of the resilient foam panel 16. The switch circuit of this embodiment provides a gap in the layer of electrically conductive ink 40 in the area of the body of a bird 68. With this, the switch circuit can be completed in this case by a user's applying his or her finger or other electrically conductive element to the bird 68 to bridge the gap. With the switch circuit completed, electrical power can be sent to the speaker, which can then emit, for example, the chirping sounds of a bird. Of course, the appearance of the switching circuit could be varied widely as could the nature of the activated electrical device.

Figure 11:
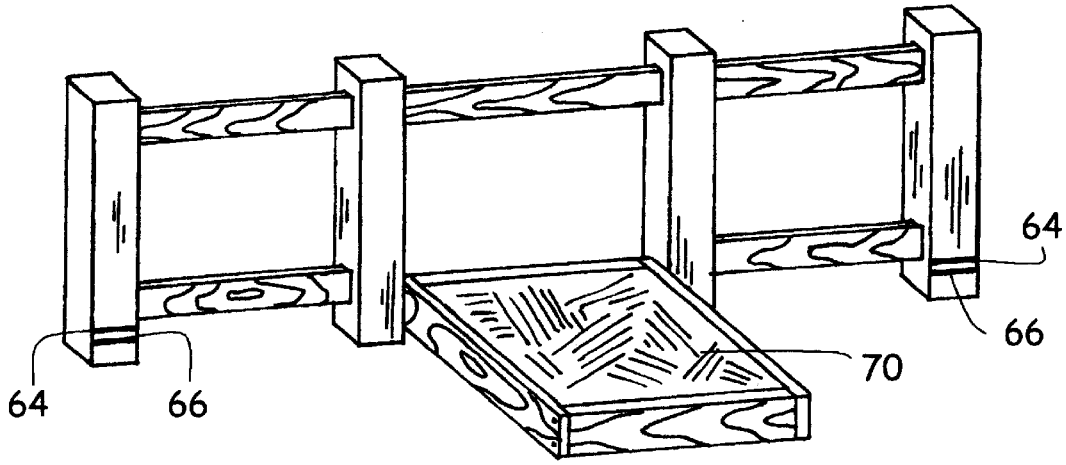
FIG. 11 is a perspective view of an alternative interactive base connector unit.

Alternatively or additionally, the invention could employ interactive base connector units 12 that pass electrical current therethrough and have switch circuits therein. By way of example, FIG. 11 shows a fence-type interactive base connector unit 12 that has first and second electrical contacts 64 and 66 disposed at each end thereof As a result, the fence 12 forms an element of an electrical circuit that includes the second electrical contacts 66 while also providing a switch circuit that includes the first electrical contacts 64. The switch circuit passes through an imitation hay bale 70 that has electrically-conductive ink applied thereto that has a gap therein that again can be completed by the application of a user's finger or other electrically conductive external element thereto. In this case, completion of the electrical circuit could cause a speaker (not shown) to emit a mooing sound or the like.

Of course, although it is not shown in this embodiment, it is entirely within the scope of the present invention to provide a traditional ON/OFF switch in addition or alternatively to the electrically conductive ink switch circuit. Furthermore, it is possible that there may be no switch on the resilient foam panel 16. In this case, the electrical circuit may be completed immediately upon insertion of the resilient foam panel 16 into an appropriately configured squeeze connector 14, which will be discussed more fully below.

Naturally, where electricity is to be passed through the resilient foam panel 16, other elements of the expandable and changeable playset building system 10 must also provide for the passage of electricity. For example, one may refer to the bridge-type interactive base connector unit 12 shown in FIG. 12 where the squeeze connectors 14 that extend therefrom each have first and second electrical contacts 72 and 74 for contacting the first and second electrical contacts 64 and 66 on a resilient foam panel 12.

Figure 12:
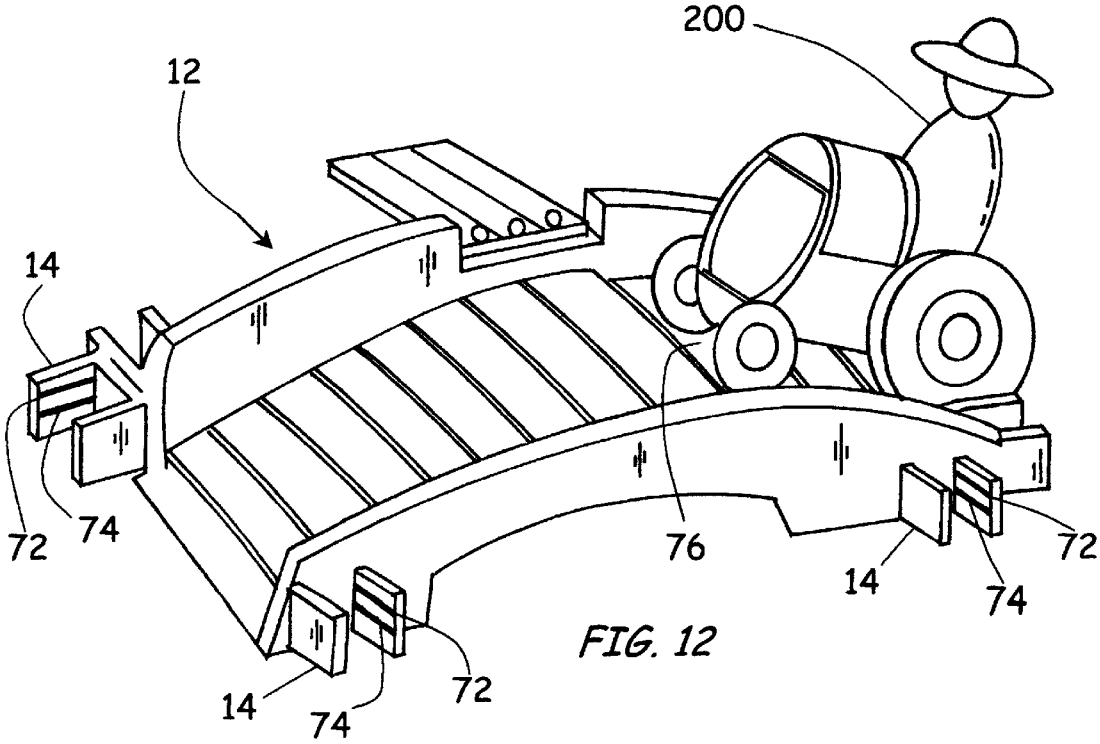
FIG. 12 is a perspective view of another alternative interactive base connector unit.
Figure 13:
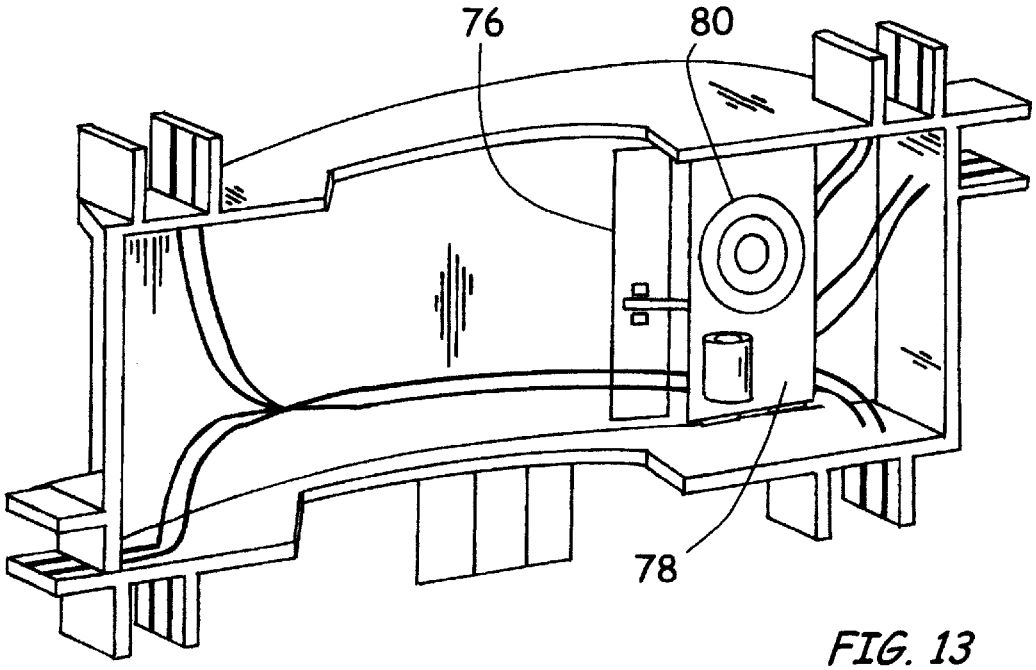
FIG. 13 is a bottom plan view of the interactive base connector unit of FIG. 12.

With additional reference to FIG. 13, one sees that the interactive base connector unit 12 of FIG. 12 shows a further unique aspect of the invention. In this embodiment, the bridge-type interactive base connector unit 12 has a plurality of imitation bridge planks with one of the bridge planks 76 comprising a mechanically actuated switch of an electrical circuit. Looking at the underside of the bridge 12, which is shown in FIG. 13, one sees that the bridge 12 retains an appropriately configured circuit board 78. To provide sound effects, a speaker 80 is affixed to the circuit board 78. FIG. 13, also depicts the mechanical coupling of the bridge plank 76 relative to the circuit board 78. Under this arrangement, a user can depress the bridge plank 76, such as by rolling a toy tractor 200 thereover, to complete the electrical circuit and to activate the speaker 80, which in this case could emit a sound of a bubbling stream.

Figure 14:
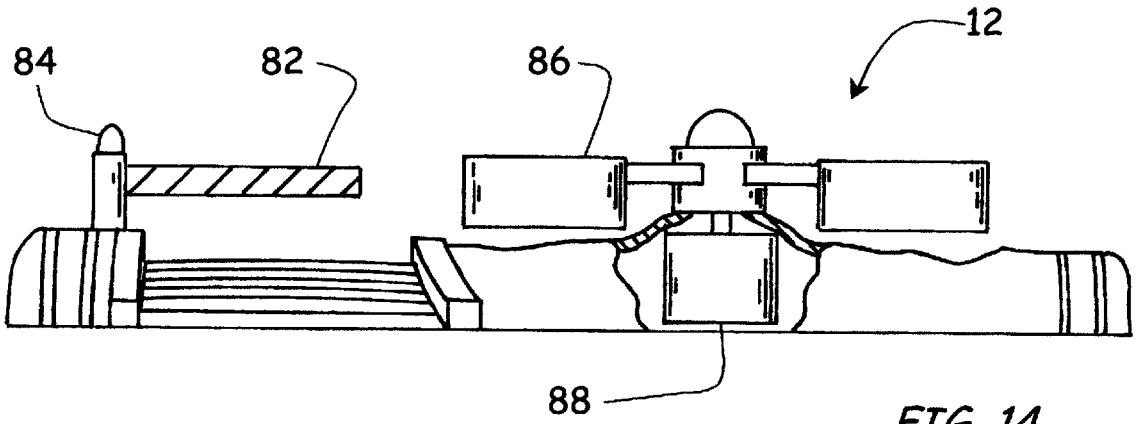
FIG. 14 is a view in side elevation of still another interactive base connector unit.
Figure 15:
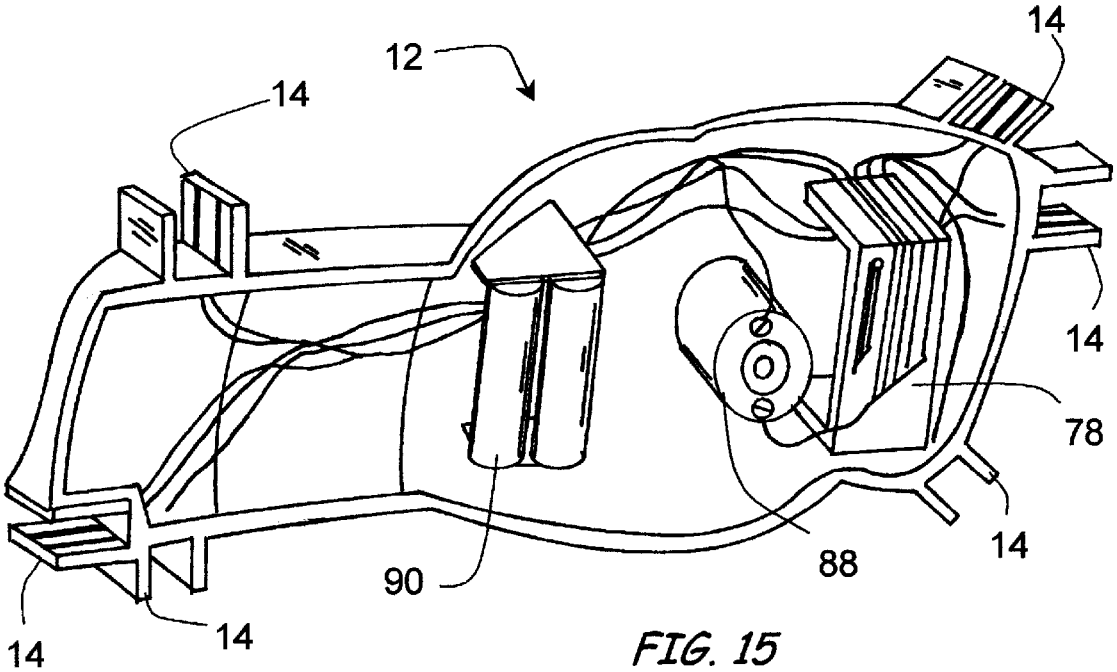
FIG. 15 is a bottom plan view of the interactive base connector unit of FIG. 14.

FIG. 14 illustrates the versatility of the present invention where the interactive base connector unit 12 is shown as a combination parking gate and merry-go-round, which is also indicated at 12. Here, the combination parking gate and merry-go-round 12 includes a parking gate 82, a light 84, and a merry-go-round 86. Looking to FIG. 15, one sees that the merry-go-round 86 is rotated by a motor 88 that is powered by batteries 90. In this case, the parking gate 82, which can be raised and lowered manually by a user, acts as a switch by which a user can activate the light 84 and can cause the merry-go-round 86 to rotate.

In light of the foregoing, it will be apparent that the present invention provides a number of advantages over the prior art. For example, with its plurality of readily moveable and reconfigurable elements, the expandable and changeable playset building system 10 is capable of assuming a wide variety of sizes and configurations. Importantly, with the use of the squeeze connectors 14, the expandable and changeable playset building system 10 can be reconfigured and supplemented in an exceedingly simple manner by a user with little expertise or dexterity. With this, a user is better able to exercise his or her imagination thereby leading to extended periods of educational and enjoyable play. Even further, the playset building system 10 can be disassembled easily for convenient storage and efficient transportation. Yet further, with the resilient foam panels 16 being retained in the resilient foam sheet 250, the invention is amenable to exceedingly neat and efficient storage and transportation while also engaging a user in a puzzle-solving activity of replacing the foam panels 16 within the foam sheet 250 in their proper location and orientation. Still further, with the unique arrangement of the electrically-conductive layers of ink 40, the squeeze connectors 14, and other elements of the playset building system 10, the invention is capable of transmitting electrical power across members of the playset building system 10 in a safe and simple manner that requires substantially no expertise on the part of a user. These and additional advantages certainly will be known to those who have reviewed the present disclosure and to those who have an opportunity to make use of an embodiment of the expandable changeable playset building system 10 disclosed herein.

One will appreciate that the present invention has been shown and described with reference to certain preferred embodiments that merely exemplify the broader invention revealed herein. Certainly, those skilled in the art can conceive of alternative embodiments. For instance, those with the major features of the invention in mind could craft embodiments that incorporate those major features while not incorporating all of the features included in the preferred embodiments.

With the foregoing in mind, the following claims are intended to define the scope of protection to be afforded the inventor, and the claims shall be deemed to include equivalent constructions insofar as they do not depart from the spirit and scope of the present invention. It should be noted that a plurality of the following claims express certain elements as a means for performing a specific function, at times without the recital of structure or material. As the law demands, these claims shall be construed to cover not only the corresponding structure and material expressly described in the specification but also equivalents thereof

What is claimed is:

1. An expandable and changeable playset building system comprising:

at least one retained playset member with a surface and a given shape and size wherein at least a portion of the retained playset member is resiliently compressible;

an interactive base connector unit that simulates a structure in miniature and in three dimensions;

a plurality of squeeze connectors coupled to the interactive base connector unit for selectively retaining by frictional engagement the at least one retained playset member wherein each of the plurality of squeeze connectors comprises a means for exerting a frictionally-engaging pressure on the resiliently compressible portion of the retained playset member comprising a pair of opposed inner gripping surfaces for frictionally engaging the resilient compressible portion of the retained playset member whereby the interactive base connector unit can retain a plurality of retained playset members and whereby the plurality of squeeze connectors and the at least one retained playset member can be retained in a given configuration by a frictional engagement between at least one of the plurality of squeeze connectors and the retained playset member; and a means for transmitting an electrical current between the interactive base connector unit and the at least one retained playset member wherein the electrical current transmitting means comprises corresponding electrical contacts on the at least one retained playset member and the inner gripping surfaces of at least one of the plurality of squeeze connectors.

2. The playset building system of claim 1 wherein the retained playset member comprises a panel of resiliently compressible material.

3. The playset building system of claim 1 further comprising an ornamental design applied to the surface of the retained playset member.

4. The playset building system of claim 1 further comprising an electrical switch operably associated with the interactive base connector unit, an electrically-powered element operably associated with the interactive base connector unit, and a means operably associated with the interactive base connector unit for activating the electrically-powered element in response to a triggering of the switch.

5. The playset building system of claim 1 wherein there are a plurality of squeeze connectors fixedly joined to form a fixed universal connector wherein the plurality of squeeze connectors have a plurality of different orientations for retaining a plurality of retained playset members in different orientations.

6. The playset building system of claim 5 wherein the plurality of squeeze connectors comprise two squeeze connectors fixed in an H configuration for retaining retained playset members in a butting relationship.

7. The playset building system of claim 1 further comprising a means for transmitting an electrical current across at least a portion of the at least one retained playset member.

8. An expandable and changeable playset building system comprising:

at least one retained playset member with a surface and a given shape and size wherein at least a portion of the retained playset member is resiliently compressible;

at least one squeeze connector for selectively retaining by frictional engagement the at least one retained playset member wherein the at least one squeeze connector comprises a means for exerting a frictional-engaging pressure on the resiliently compressible portion of the retained playset member whereby the squeeze connector and the at least one retained playset member can be retained in a given configuration by a frictional engagement between the squeeze connector and the retained playset member; and a means for transmitting an electrical current across at least a portion of the at least one retained playset member wherein the means for transmitting an electrical current across at least a portion of the at least one retained playset member comprises a layer of electrically conductive ink applied to at least a portion of the surface of the at least one retained playset member.

9. The playset building system of claim 8 wherein the at least one squeeze connector comprises a pair of opposed inner gripping surfaces for frictionally engaging the resilient compressible portion of the retained playset member.

10. The playset building system of claim 9 further comprising an interactive base connector unit that simulates a structure in miniature and in three dimensions and wherein the at least one squeeze connector is coupled to the interactive base connector unit.

11. The playset building system of claim 10 wherein a plurality of squeeze connectors are coupled to the interactive base connector unit whereby the interactive base connector unit can retain a plurality of retained playset members.

12. The playset building system of claim 11 wherein the interactive base connector unit simulates a structure chosen from the group consisting of a bridge, a tree, a fence, a merry-go-round, and a parking gate.

13. The playset building system of claim 8 further comprising a means for transmitting electrical current between the at least one retained playset member and the at least one squeeze connector comprising corresponding electrical contacts disposed on the at least one retained playset member and the at least one squeeze connector.

14. The playset building system of claim 8 wherein the means for transmitting electrical current across at least a portion of the at least one retained playset member comprises a continuous first electrical path for transmitting electrical current and a second electrical path with a gap therein for acting as a switch for allowing electricity to pass along the first electrical path when the gap is closed.

15. The playset building system of claim 14 wherein at least the second electrical path comprises a layer of electrically-conductive ink applied to at least a portion of the surface of the at least one retained playset member and wherein a user can close the gap and allow electricity to pass along the first electrical path by application of an external electrically conductive element that bridges the gap.

16. An expandable and changeable playset building system comprising:

at least one retained playset member with a surface and a given shape and size wherein at least a portion of the retained playset member is resiliently compressible;

at least one squeeze connector for selectively retaining by frictional engagement the at least one retained playset member wherein the at least one squeeze connector comprises a means for exerting a frictionally-engaging pressure on the resiliently compressible portion of the retained playset member comprising a pair of opposed inner gripping surfaces for frictionally engaging the resilient compressible portion of the retained playset member whereby the squeeze connector and the at least one retained playset member can be retained in a given configuration by a frictional engagement between the squeeze connector and the retained playset member;

an interactive base connector unit that simulates a structure in miniature and in three dimensions wherein the at least one squeeze connector is coupled to the interactive base connector unit; and an electrical switch operably associated with the interactive base connector unit an electrically-powered element operably associated with the interactive base connector unit and a means operably associated with the interactive base connector unit for activating the electrically-powered element in response to a triggering of the switch wherein the electrical switch comprises a layer of electrically conductive ink applied to at least a portion of the interactive base connector unit with a gap therein wherein a user can close the gap to trigger the switch by application of an external electrically conductive element that bridges the gap.

17. An expandable and changeable playset building system comprising:

at least one retained playset member with a surface and a given shape and size wherein at least a portion of the retained playset member is resiliently compressible;

at least one squeeze connector for selectively retaining by frictional engagement the at least one retained playset member wherein the at least one squeeze connector comprises a means for exerting a frictionally-engaging pressure on the resiliently compressible portion of the retained playset member comprising a pair of opposed inner gripping surfaces for frictionally engaging the resilient compressible portion of the retained playset member whereby the squeeze connector and the at least one retained playset member can be retained in a given configuration by a frictional engagement between the squeeze connector and the retained playset member;

an interactive base connector unit that simulates a structure in miniature and in three dimensions wherein the at least one squeeze connector is coupled to the interactive base connector unit; and an electrical switch operably associated with the interactive base connector unit, an electrically-powered element operably associated with the interactive base connector unit, and a means operably associated with the interactive base connector unit for activating the electrically-powered element in response to a triggering of the switch;

wherein the interactive base connector unit simulates in miniature and in three dimensions a bridge and wherein the switch comprises a plank in the bridge that is triggered by a displacement of the plank.

18. The playset building system of claim 17 wherein the opposed inner gripping surfaces of the at least one squeeze connector terminate in arcuate outer edges that are inwardly angled whereby the outer edges exhibit a funnel-type configuration for better receiving and compressing the resiliently compressible portion of the retained playset member.

19. The playset building system of claim 18 wherein the resiliently compressible portion of the retained playset member has a given thickness and wherein the opposed inner gripping surfaces of the squeeze connector are closer together than the thickness of the resiliently compressible portion of the retained playset member.

20. An expandable and changeable playset building system comprising:

at east one retained playset member with a surface and a given shape and size wherein at least a portion of the retained playset member is resiliently compressible; and at least two squeeze connectors for selectively retaining by frictional engagement the at least one retained playset member comprising a first squeeze connector and a second squeeze connector wherein the first squeeze connector is rotatably coupled to the second squeeze connector whereby the orientation of the first squeeze connector relative to the second squeeze connector can be varied readily and wherein each squeeze connector comprises a means for exerting a frictionally-engaging pressure on the resiliently compressible portion of the retained playset member whereby the at least two squeeze connectors and the at least one retained playset member can be retained in a given configuration by a frictional engagement between at least one of the at least two squeeze connectors and the retained playset member.

* * * * *